US008330371B2

(12) United States Patent
Kostrun et al.

(10) Patent No.: US 8,330,371 B2
(45) Date of Patent: Dec. 11, 2012

(54) APPARATUS, SYSTEM, AND METHOD OF CONTROLLING IGNITION TIMING OF A HID LAMP USING A THIRD ELECTRODE

(75) Inventors: Marijan Kostrun, Beverly, MA (US); Helmar Adler, Danvers, MA (US)

(73) Assignee: Osram Sylvania Inc., Danvers, MA (US)

( * ) Notice: Subject to any disclaimer, the term of this patent is extended or adjusted under 35 U.S.C. 154(b) by 308 days.

(21) Appl. No.: 12/882,148

(22) Filed: Sep. 14, 2010

(65) Prior Publication Data

US 2012/0062112 A1 Mar. 15, 2012

(51) Int. Cl.
*H01J 17/16* (2006.01)

(52) U.S. Cl. ..... 313/636; 313/634

(58) Field of Classification Search ..... 313/636, 313/634

See application file for complete search history.

(56) References Cited

U.S. PATENT DOCUMENTS

| | | | |
|---|---|---|---|
| 4,010,397 | A | 3/1977 | Hon |
| 6,201,348 | B1 | 3/2001 | Nortrup et al. |
| 6,707,263 | B1 | 3/2004 | Prasad |
| 7,038,383 | B2 | 5/2006 | Butler et al. |
| 7,187,131 | B2 | 3/2007 | Budinger |
| 2009/0289551 | A1 | 11/2009 | Scholler et al. |

FOREIGN PATENT DOCUMENTS

| | | |
|---|---|---|
| DE | 102005007680 | 8/2006 |

*Primary Examiner* — Tuyet Thi Vo

(74) *Attorney, Agent, or Firm* — Robert F. Clark; Andrew Martin

(57) ABSTRACT

A high-intensity discharge (HID) lamp comprising a discharge vessel including a first and a second end region and defining an arc chamber containing an arc generating medium, a cathode and an anode in the first and the second end regions of the discharge vessel, respectively, the cathode and the anode each comprising a terminal end disposed within the arc chamber and separated by an arc gap, and an electrically conductive starting aid configured to initiate a dielectric barrier discharge (DBD) with the anode at or after a voltage across the first and second electrodes reaches an open circuit value. A ballast may control power provided to the HID lamp.

20 Claims, 5 Drawing Sheets

APPARATUS, SYSTEM, AND METHOD OF CONTROLLING IGNITION TIMING OF A HID LAMP USING A THIRD ELECTRODE

TECHNICAL FIELD

The present disclosure relates to arc discharge light sources, and, more particularly, to a high-intensity discharge (HID) lamp having a starting aid and method of forming the same.

BACKGROUND

A high-intensity discharge (HID) lamp uses a plasma arc to produce light. HID lamps have been widely used as a viable option for producing efficient illumination for many different types of applications requiring a light source. When compared with fluorescent and incandescent lamps, HID lamps have higher luminous efficacy since a greater proportion of input energy is converted into visible light as opposed to heat. In general, a HID lamp produces light by means of an electric arc between electrodes housed inside a discharge vessel (also known as an arc tube or burner) typically filled with both gas and metal salts, whereby the gas facilitates the arc's initial strike. Once the arc is started, it heats and evaporates the metal salts forming a plasma, which greatly increases the intensity of light produced by the arc and reduces its power consumption. A HID lamp may require high voltage to initialize the arc.

BRIEF DESCRIPTION OF THE DRAWINGS

Features and advantages of the claimed subject matter will be apparent from the following detailed description of embodiments consistent therewith, which description should be considered with reference to the accompanying drawings, wherein:

DETAILED DESCRIPTION

By way of an overview, one embodiment of the instant application may be directed to an apparatus, system, and method for starting a high-intensity discharge (HID) lamp. For example, a HID lamp consistent with the present disclosure may comprise an outer jacket and a base surrounding a hollow body (e.g., a discharge vessel). The discharge vessel may define a chamber containing an arc generating/sustaining medium, a cathode and an anode disposed at opposite ends within the chamber, and an electrically conductive starting aid comprising a third electrode. By selecting the resistance of the electrically conductive starting aid, the intensity of the firing of a dielectric barrier discharge (DBD) created in the discharge vessel between the adjacent main electrode (e.g., the anode) and the third electrode may be increased. In particular, the resistance value of the third electrode may be selected to provide a desired delay of the DBD with respect to the rise of the voltage across the main electrodes (i.e., the cathode and anode) such that the DBD is initiated at or after a voltage across the cathode and anode reaches an open circuit value. For example, the third electrode may be selected to have a resistance value of 1-100 Ω in order to provide a delay of the DBD of 20-50 ns relative to the rise of the voltage across the cathode and anode. As such, an apparatus, system, and method according to the present disclosure may prevent the "early" firing of the DBD.

Figure 1:
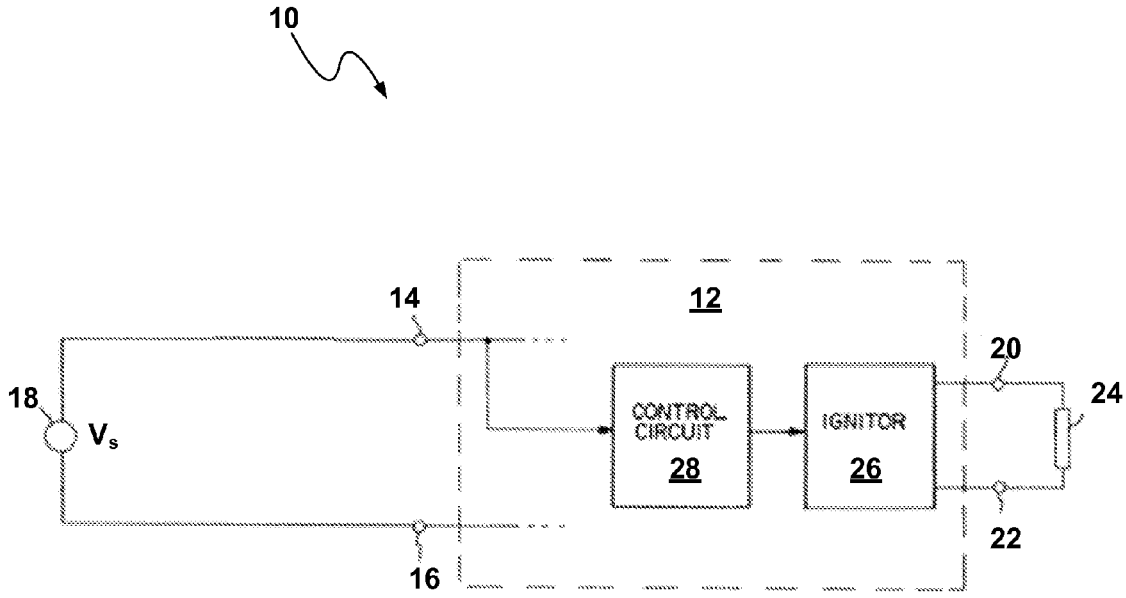
FIG. 1 illustrates a high intensity discharge (HID) lamp system according one embodiment of the present disclosure.

Turning now to FIG. 1, one embodiment of a HID lamp system 10 is generally illustrated. The HID lamp system 10 may be particularly useful in automotive applications; however, the HID lamp system 10 may also be utilized in other applications that require use of HID lamps such as, but not limited to, interior and/or exterior building lighting applications, industrial lighting applications, or the like.

The HID lamp system 10 may comprise a ballast 12 including a pair of input connections 14, 16 adapted to receive a voltage source $V_s$ from a power source 18, and a pair of output connections 20, 22 for connection to at least one HID lamp 24. The power source 18 may be either alternating current (AC) and/or direct current (DC) and may comprise an inverter and/or converter (not shown for clarity) depending on the application. The ballast 12 may comprise an ignitor 26 and a control circuit 28. The ignitor 26 may be coupled to output connections 20, 22. The control circuit 28 may be coupled to ignitor 26. The ignitor 26 and the control circuit 28 may be realizable by any of a number of suitable circuits known in the art. It should, of course, be understood that system 10 may include other circuits for providing steady-state power to lamp 24 and a suitable front-end for providing current-limiting and/or power factor correction, which are not shown or described in detail herein for clarity.

The HID lamp 24 may produce light by way of an electric arc between electrodes housed inside a discharge vessel that may be filled with an arc-generating and sustaining medium (e.g., gas and/or metal salts) that facilitates the arc's initial strike. Once the arc is started, the arc heats and evaporates the metal salts forming a plasma, which greatly increases the intensity of light produced by the arc and reduces the power consumption of the HID lamp 24.

The ballast 12 may be configured to control the power provided to the HID lamp 24 during at least two conditions; i.e., before starting during which the HID lamp 24 may present a condition similar to an open circuit and after starting during which the HID lamp 24 may present a condition tantamount to a short-circuit. In particular, the ignitor 26 may provide one or more high voltage ignition pulses between the output connections 20, 22 for igniting the lamp 24. In the case of a high-pressure automotive HID lamp, the lamp without starting aid requires 17-30 kV to strike the arc, whereas the lamp with the starting aid described herein requires 9-11 kV. The control circuit 28, which is coupled to ignitor 26, may control when and how the ignitor 26 provides the ignition pulse(s). Due to the unique starting requirements, the HID lamp 24 may include an electrically conductive starting aid (and more specifically a third electrode of the HID lamp 24) to facilitate initiating the start of the arc in the HID lamp 24.

Figure 2:
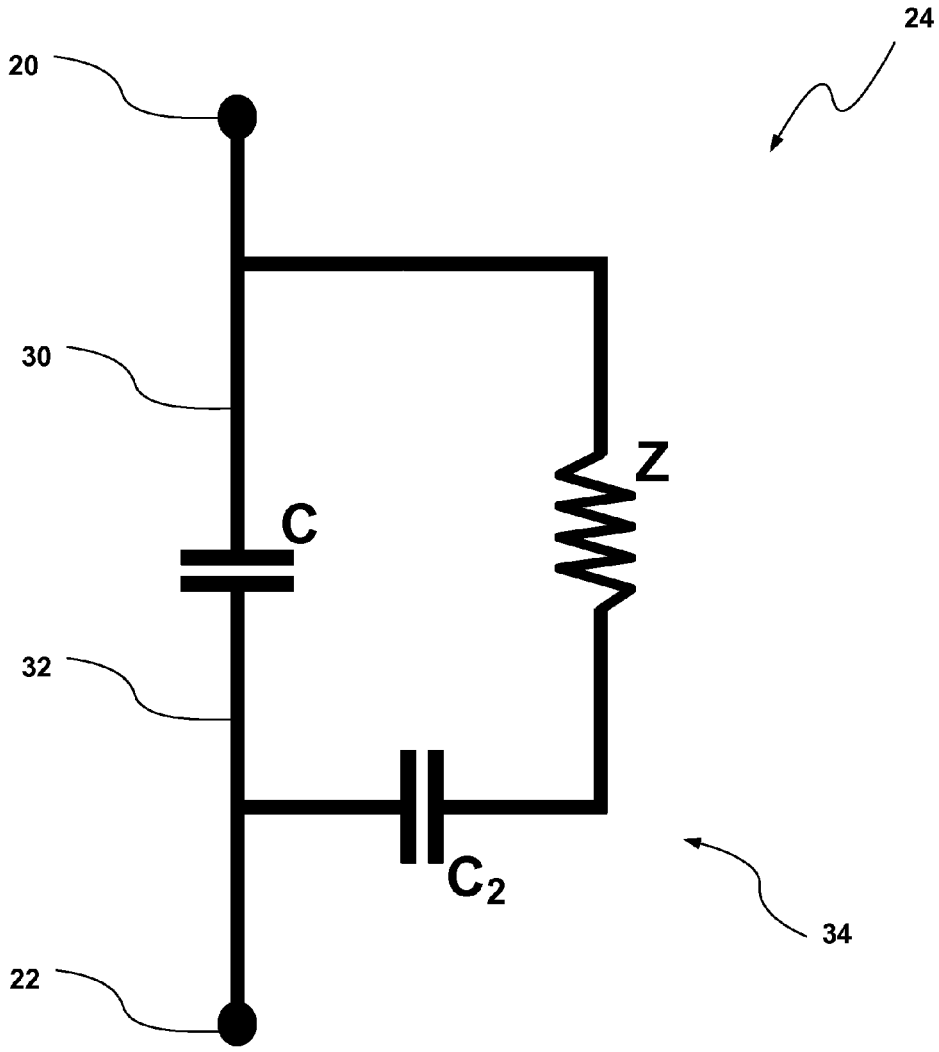
FIG. 2 illustrates a schematic circuit diagram of a HID lamp according to one embodiment of the present disclosure.

Turning now to FIG. 2, a circuit diagram consistent with one embodiment of a HID lamp 24 with starting aid is generally illustrated. The HID lamp 24 may comprise a first and a second main electrode (e.g., a cathode 30 and an anode 32) and an electrically conductive starting aid 34. The cathode and anode 30, 32 may be represented as a capacitor C. The electrically conductive starting aid 34, which together with the adjacent main electrode may be represented as a capacitor $C_2$, is configured so as to fire the dielectric barrier discharge (DBD) at the main electrode anode 32. As used herein, the term "dielectric barrier discharge" refers to the electrical discharge between two electrodes (e.g., a cathode and anode) separated by an insulating dielectric barrier. During operation of the HID lamp 24, a multitude of random arcs may form between the two electrodes. As the charges collect on the surface of the dielectric, they can discharge in microseconds, leading to their reformation elsewhere on the surface. The plasma generated within the HID lamp 24 may be sustained if the continuous energy source to the HID lamp 24 provides the required degree of ionization, overcoming the recombination process leading to the extinction of the discharge. Such recombinations are directly proportional to the collisions between the molecules and, in turn, to the pressure of the gas within the HID lamp 24. The discharge process causes the emission of an energetic photon, the energy of which corresponds to the type of gas used to fill the discharge vessel of the HID lamp.

Once the DBD fires, the breakdown between the main electrodes 30, 32 can proceed in one of the two possible paths. The DBD can serve as a seed discharge for a positive streamer that propagates along the inner surface of the discharge vessel to the cathode 30, or it can produce ultraviolet (UV) and vacuum ultraviolet (VUV) photons which produce a large number of photo-electrons at the cathode 30, and thus seed a negative streamer.

Control over the potential of the electrically conductive starting aid 34 may be achieved by connecting it to the opposite cathode 30, herein referenced as an E3 device. An HID lamp 24 consistent with the present disclosure may allow the ignition voltage provided to the HID lamp 24 to be reduced while significantly increasing the ignitability of the HID lamp 24.

It has also been shown that, even with a reduced ignition voltage in HID lamps 24 employing an E3 device, two types of breakdown may occur, which differ in respect to when the DBD fires following an onset of a high voltage ignition pulse. One type of breakdown occurs, for example, when the DBD fires "early" while the ignition voltage of the cathode 30 and anode 32 is still rising. When this occurs, the firing of the DBD is less intense and it creates an electron photo-current that can prevent further increase of the voltage across the cathode 30 and anode 32. Thus, the "early" firing of the DBD produces undesirable results. Another type of breakdown occurs, for example, when the DBD fires "late," meaning that the voltage across the cathode 30 and anode 32 has had sufficient time to reach an open circuit value. When the DBD fires "late" the striking of the arc between the main electrodes 30 and 32 is more energetic than when the DBD fires "early." Thus, the present disclosure may comprise an electrically conductive starting aid 34 configured to initiate the DBD with the anode 32 at or after a voltage across the cathode 30 and the anode 34 reaches an open circuit value.

The present disclosure may prevent an early firing of the DBD by controlling the time delay between the voltage across the anode 30 and the third electrode 34 and the voltage between the main electrodes 30 and 32 through controlling the resistance of the electrically conductive starting aid 34. In particular, the electrically conductive starting aid 34 may be considered to be a very small capacitor $C_2$, for example, with a value $C_2$ of approximately 0.5 pF (e.g., but not limited to, 0.4-0.6 pF). Given the rise time of the typical ignition pulses provided by the ballast 12 (FIG. 1), the present disclosure may delay the voltage across $C_2$ by 20-50 ns compared to the voltage across the main electrodes 30, 32. The delay may be achieved by adjusting the resistance of a component (generally illustrated by resistor Z) in series with $C_2$. In particular, the rise of the voltage across $C_2$ may be adjusted by adjusting the RC time constant $\tau$. The RC time constant $\tau$ may be represented by the following formula:

$$\tau = ZC_2$$

wherein Z is the resistance and $C_2$ is the capacitance of the electrically conductive starting aid 34. By adjusting the resistance of Z, the time for the voltage of $C_2$ to rise to its peak voltage may be adjusted and the firing of the DBD may be timed to occur at or after the voltage across the cathode 30 and anode 32 reaches an open circuit value, thereby increasing the ignitability of the HID lamp 24.

According to one embodiment, the DBD may be delayed 20-50 ns compared to the voltage across the main electrodes 30, 32. For a conductive starting aid 34 a value $C_2$ of approximately 0.5 pF, the component may have a resistance in the range of 1-100 kΩ. The resistance of component Z may also (or alternatively) be greater than or equal to 40 kΩ, in the range of 10-100 kΩ, 1-10 kΩ, 5-10 kΩ, or any value or range therein.

Figure 3:
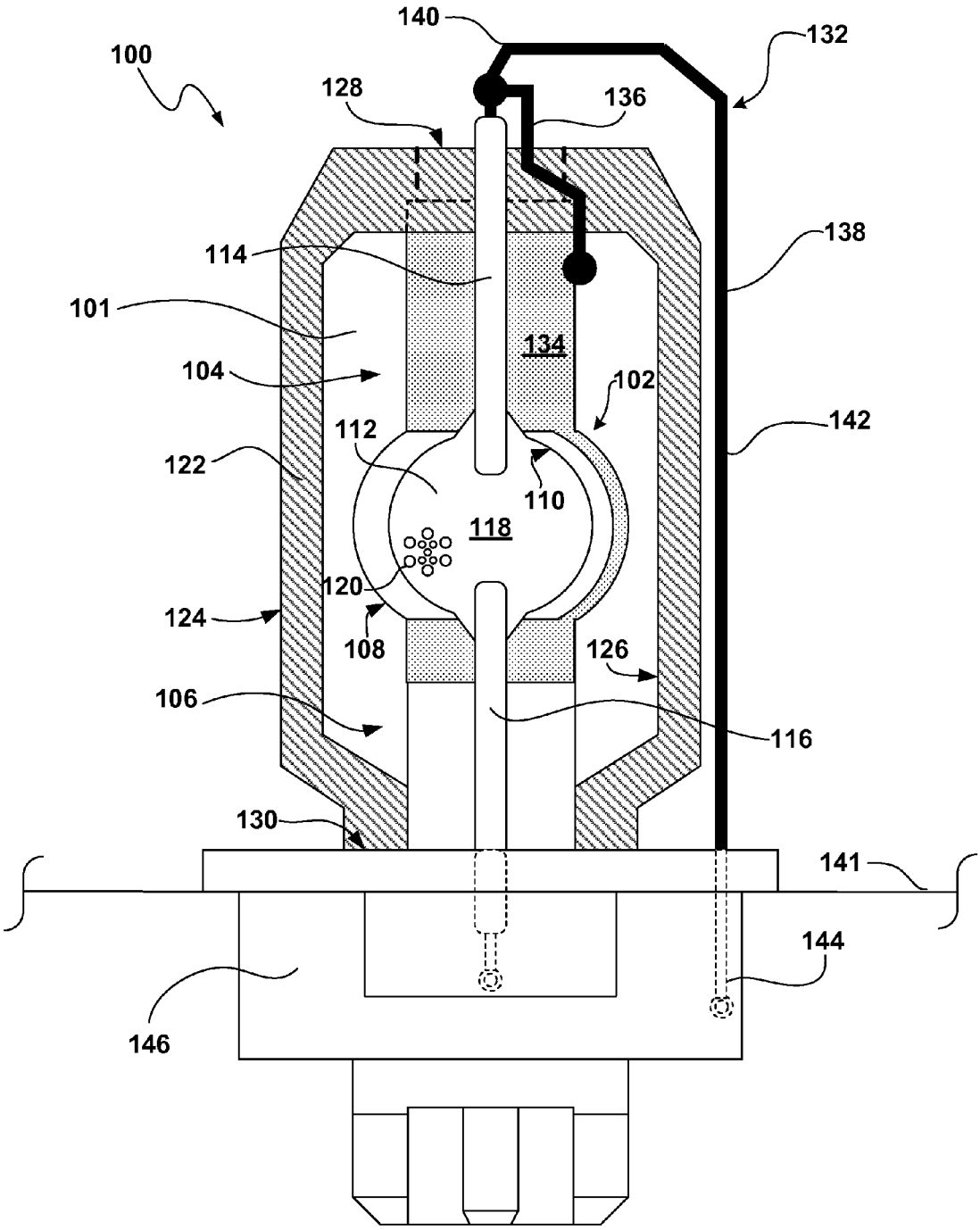
FIG. 3 illustrates a cross-sectional view of a HID lamp according to one embodiment of the present disclosure.

Turning now to FIG. 3, a cross-sectional view of one embodiment of a HID lamp 100 consistent with the present disclosure is generally illustrated. The HID lamp 100 may include a hollow body or discharge vessel 102 and an outer jacket 122. The discharge vessel 102 may comprise a translucent and/or transparent material (such as, but not limited to, fused quartz, fused alumina, or the like) defining an arc chamber 112. The outer jacket 122 may define a jacket chamber 101 configured to surround at least a portion of the discharge vessel 102 and protect the discharge vessel 102. The discharge vessel 102 and/or the outer jacket 122 may be coupled to a base 146. The base 146 may be configured to mechanically and/or electrically couple the HID lamp 100 to a socket or receptacle 141 and a ballast/power supply (not shown in FIG. 3 figure for clarity).

The HID lamp 100 may also include a first and a second electrode 114, 116 sealed in first and second end regions 104, 106 of the discharge vessel 102, respectively. At least a portion of the first electrode 114 may extend across the first end regions 128, 104 of outer jacket 122 and/or the discharge vessel 102 and may terminate within the arc chamber 112. At least a portion of the second electrode 116 may extend across the second end regions 130, 106 of the outer jacket 122 and/or discharge vessel 102 and may terminate within the arc chamber 112. In one embodiment, the first and the second electrodes 114, 116 may include a cathode and an anode, respectively. The electrodes 114, 116 may include a conductive material (such as, but not limited to, tungsten or the like) and may be configured to be connected to the power supply and ballast (not shown for clarity).

The HID lamp 100 may also include an arc gap 118 within the arc chamber 112. The arc gap 112 may be defined by a void or space between the terminal ends of the cathode 114 and the anode 116 within the arc chamber 112. An arc and/or plasma generating and sustaining medium 120 may be contained within the arc chamber 112. The medium 120 may include a gas and/or metal salts such as, but not limited to, neon, argon, xenon, krypton, sodium, metal halides, and/or mercury.

The HID lamp 100 may also include an electrically conductive starting aid 132 coupled to the discharge vessel 102. The electrically conductive starting aid 132 may comprise an electrically conductive coating 134 (i.e., a third electrode) an electrically conductive member 136, and an electrically conductive return wire 138. The conductive coating 134 may include a transparent material extending from the first end region 104 generally along a length of the exterior surface 108 of the discharge vessel 102. In one embodiment, the conductive coating 134 may be configured to provide the desired resistance Z as described herein (e.g., but not limited to, 1-100 kΩ) such that the DBD is initiated with the second electrode 116 at or after the voltage across the first and second electrodes 114, 116 reaches an open circuit value. The resistance of the conductive coating 134 may be selected by adjusting the amount of conductive materials and/or the size/shape of the coating 134, from its specific resistance.

The electrically conductive member 136 may be coupled to the conductive coating 134 and the electrically conductive return wire 138. For example, the conductive member 136 may extend from the exterior surface 124 to the interior surface 126 of the outer jacket 122 at the first end region 128 of the jacket 122. The return wire 138 may also define an intermediate portion 142 that may extend at least a length of the discharge vessel 102. A first end 140 of the return wire 138 may be coupled to the cathode 114 while a second end 144 may be configured to be electrically connected with a power supply and/or ballast (not shown). The conductive member 136 and/or the return wire 138 may include a conducting wire, a conducting tape, or the like.

Figure 4:
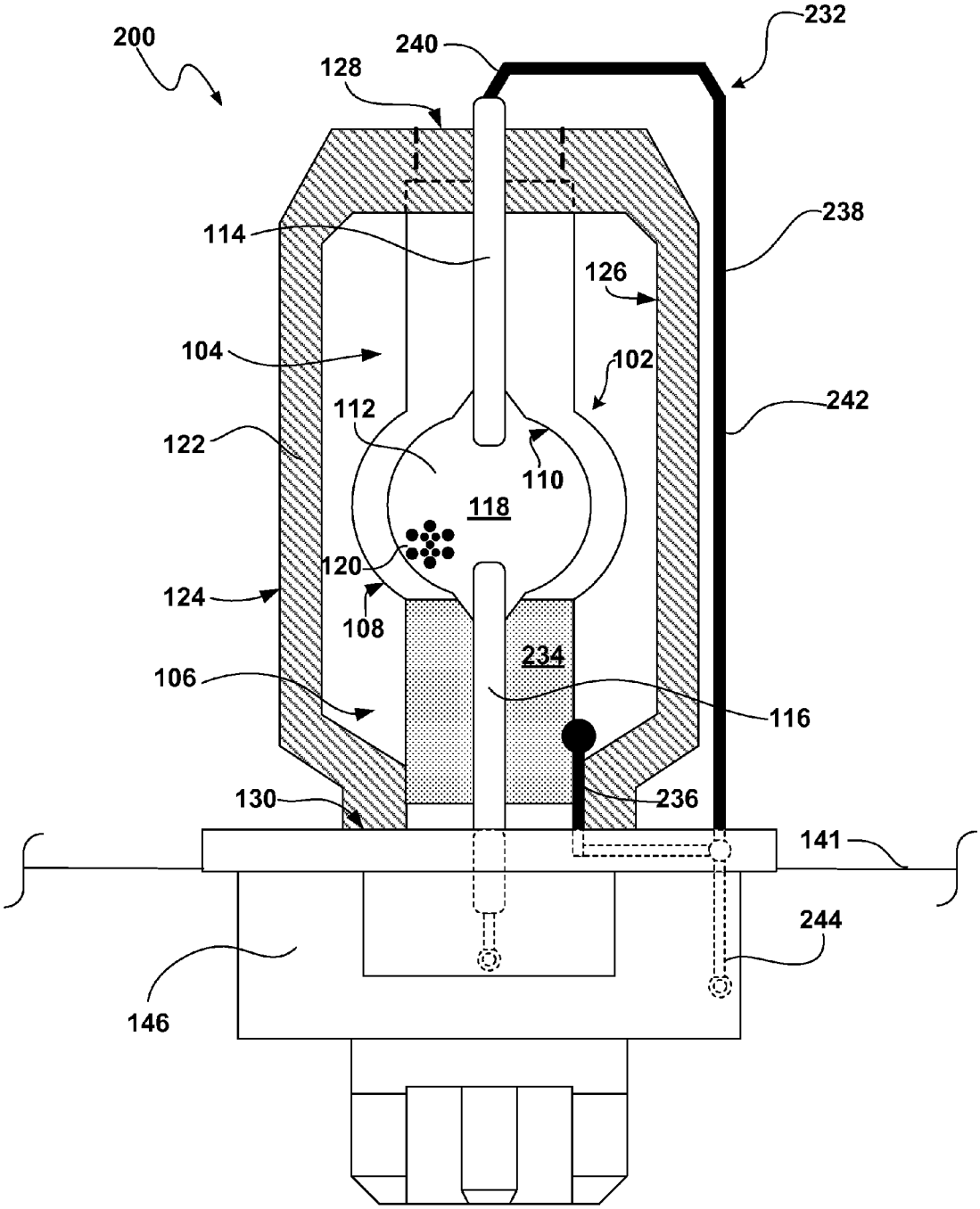
FIG. 4 illustrates a cross-sectional view of a HID lamp according to another embodiment of the present disclosure.

Turning now to FIG. 4, a cross-sectional view of another embodiment of a HID lamp 200 consistent with the present disclosure is generally illustrated. Components similar to those illustrated and/or described in FIG. 3 have been assigned like reference numerals, and are not described again for clarity. The HID lamp 200 may include an electrically conductive starting aid 232 coupled to the discharge vessel 102. The electrically conductive starting aid 232 may comprise an electrically conductive coating 234 (i.e., a third electrode), an electrically conductive member 236, and an electrically conductive return wire 238. The conductive coating 234 may include a transparent material extending from the second end region 106 of the discharge vessel generally along a length of the exterior surface 108 of the discharge vessel 102. The conductive coating 234 may aid in initiating the DBD between the coating 234 and the anode 116. For example, the conductive coating 134 may be configured to provide the desired resistance Z as described herein (e.g., but not limited to, 1-100 kΩ) such that the DBD is initiated with the second electrode 116 at or after the voltage across the first and second electrodes 114, 116 reaches an open circuit value. The resistance of the conductive coating 234 may be selected by adjusting the amount of conductive materials and/or the size/shape of the coating 234.

The electrically conductive member 236 may be coupled to a portion of the coating 234 and to the return wire 238. For example, the conductive member 236 may extend from the exterior surface 124 to the interior surface 126 of the outer jacket 122 at the second end 130 of the outer jacket 122. The return wire 238 may include a first end 240 coupled to at least a portion of the cathode 114 and an intermediate portion 242 that may extend at least a length of the discharge vessel 102. A second end 244 of the return wire 238 may be configured to be electrically connected with a power supply and/or ballast (not shown).

Figure 5:
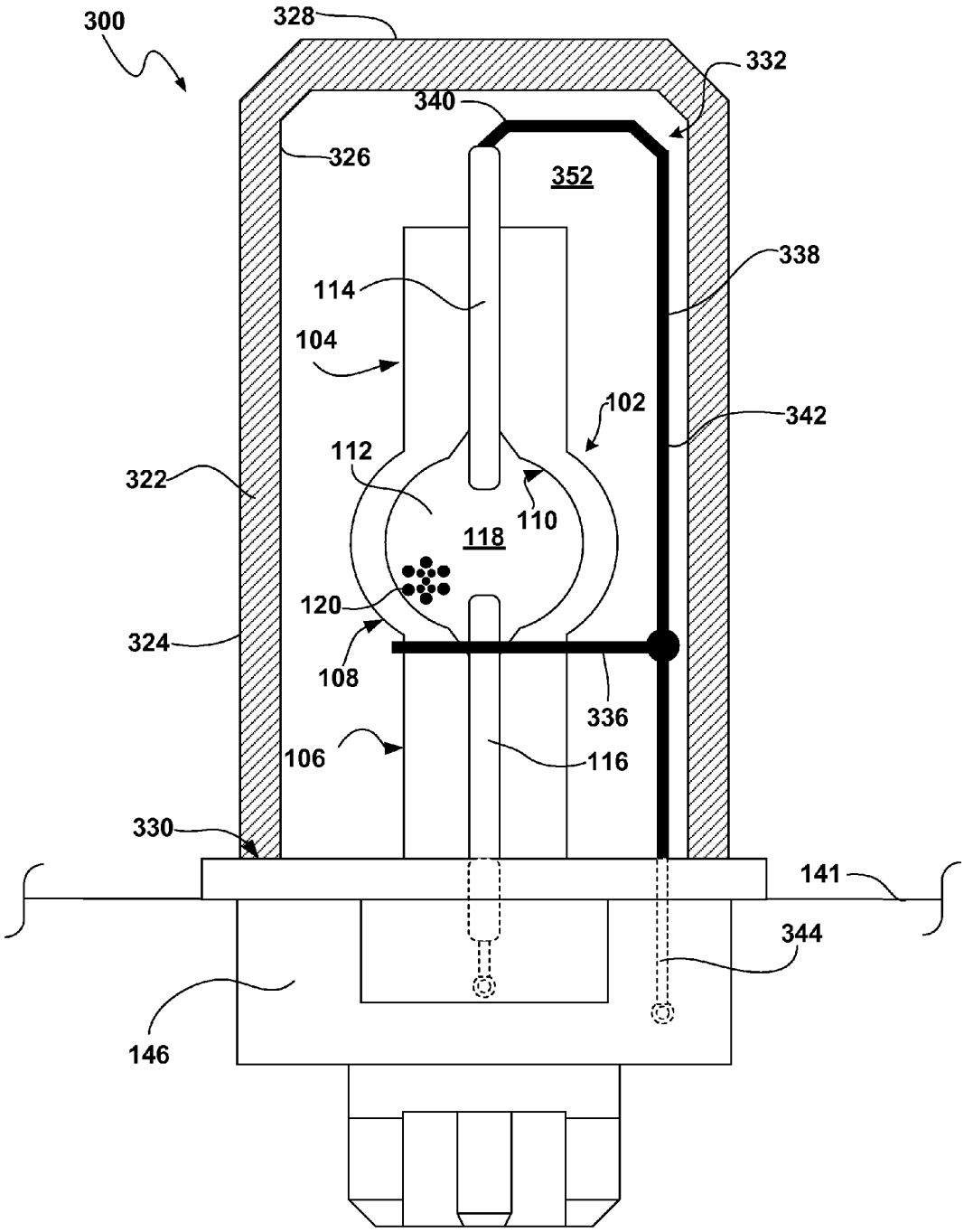
FIG. 5 illustrates a cross-sectional view of a HID lamp according to yet another embodiment of the present disclosure.

Turning now to FIG. 5, a cross-sectional view of yet another embodiment a HID lamp 300 consistent with the present disclosure is generally illustrated. Components similar to those illustrated and/or described in FIGS. 3 and/or 4 have been assigned like reference numerals, and are not described again for clarity. The HID lamp 300 may include a hollow body or discharge vessel 102 and an outer jacket 322. The HID lamp 300 may also include an electrically conductive starting aid 332 coupled to the discharge vessel 102. The starting aid 332 may comprise an electrically conductive member 336 and an electrically conductive return wire 338. The conductive member 336 may include a resistive material coupled to and circumscribing at least a portion of the discharge vessel 102. For example, the conductive member 336 may comprise a sheath-like electrical conductor such as, but not limited to, a wire winding around the second end region 106 of the discharge vessel 102. The conductive member 336 may be wound at least two revolutions around the second end region 106. The conductive member 336 may aid in initiating the DBD between with the anode 116. For example, the conductive member 336 may be configured to provide the desired resistance Z as described herein (e.g., but not limited to, 1-100 kΩ) such that the DBD is initiated with the second electrode 116 at or after the voltage across the first and second electrodes 114, 116 reaches an open circuit value. The resistance of the conductive member 336 may be selected by adjusting the amount of conductive materials and/or the size/shape of the conductive member 336.

The conductive return wire 338 may be coupled to the conductive member 336. A first end 340 region of the return wire 338 may be coupled to the cathode 114 and an intermediate portion 342 of the return wire 338 may extend along a length of the discharge vessel 102. A second end 344 of the return wire 338 may be configured to be electrically connected with a power supply and/or ballast (not shown).

The outer jacket 322 of the HID lamp 300 may be configured to surround the discharge vessel 102 and the starting aid 332. The outer jacket 322 may have an exterior surface 324 and an interior surface 326 and may also define a first end 328 and a second end 330. At least a portion of the anode 116 may extend from the discharge vessel 102 and exit the second end 330 of the jacket 322. Accordingly, the starting aid 332 (and in particular the return wire 342) may be disposed/positioned within the interior chamber 352 of the outer jacket 322.

In one aspect, the present disclosure may feature a HID lamp. The HID lamp may comprise a discharge vessel, a first and a second electrode, and an electrically conductive starting aid. The discharge vessel may comprise a first and a second end region and define an arc chamber containing an arc generating medium. The first and second electrodes may be sealed in the first and the second end regions of the discharge vessel, respectively. The first and the second electrodes may each comprise a terminal end disposed within the arc chamber and separated by an arc gap. The electrically conductive starting aid may be configured to initiate a dielectric barrier discharge (DBD) with the second electrode at or after a voltage across the first and second electrodes reaches an open circuit value.

In another aspect, the present disclosure may feature a HID lamp system. The HID lamp system may comprise an HID lamp and a ballast configured to provide power to the HID lamp. The HID lamp may comprise a discharge vessel including a first and a second end region and defining an arc chamber containing an arc generating medium, a cathode and an anode in the first and the second end regions of the discharge vessel, respectively, wherein the cathode and the anode each comprising a terminal end disposed within the arc chamber and separated by an arc gap, and an electrically conductive starting aid configured to initiate a dielectric barrier discharge (DBD) with the anode at or after a voltage across the cathode and anode reaches an open circuit value.

In yet another aspect, the present disclosure may feature a method of igniting a HID lamp. The method may comprise providing a discharge vessel including a first and a second end region and defining an arc chamber containing an arc generating medium, providing a first and a second electrode sealed in the first and the second end regions of the discharge vessel, respectively, wherein the first and the second electrodes each comprise a terminal end disposed within the arc chamber and separated by an arc gap, and initiating a dielectric barrier discharge (DBD) with the second electrode at or after a voltage across the first and second electrodes reaches an open circuit value.

While several embodiments of the present disclosure have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present disclosure. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present disclosure is/are used. Those skilled in the art will recognize, or be able to ascertain using no more than routine experimentation, many equivalents to the specific embodiments of the disclosure described herein. It is, therefore, to be understood that the foregoing embodiments are presented by way of example only and that, within the scope of the appended claims and equivalents thereto, the disclosure may be practiced otherwise than as specifically described and claimed. The present disclosure is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

All references, patents and patent applications and publications that are cited or referred to in this application are incorporated in their entirety herein by reference.

Additional disclosure in the format of claims is set forth below:

The invention claimed is:

1. A high-intensity discharge (HID) lamp comprising:

a discharge vessel comprising a first and a second end region and defining an arc chamber containing an arc generating medium;

a first and a second electrode sealed in the first and the second end regions of the discharge vessel, respectively, the first and the second electrodes each comprising a terminal end disposed within the arc chamber and separated by an arc gap; and an electrically conductive starting aid configured to initiate a dielectric barrier discharge (DBD) with the second electrode at or after a voltage across the first and second electrodes reaches an open circuit value.

2. The HID lamp of claim 1, wherein the first and the second electrodes comprise a cathode and an anode, respectively.

3. The HID lamp of claim 2, wherein the electrically conductive starting aid is configured to delay the DBD 20-50 nanoseconds after the voltage across the cathode and the anode reaches the open circuit value.

4. The HID lamp of claim 3, wherein prior to the DBD, the cathode and the electrically conductive starting aid form a capacitor having a value of 0.4-0.6 pF.

5. The HID lamp of claim 4, wherein the electrically conductive starting aid has a resistance value of 1-100 kΩ.

6. The HID lamp of claim 2 further comprising:

a base configured to be received in a socket, said base comprising a first and a second connector configured to electrically connect the cathode, the anode, and the electrically conductive starting aid to a power source; and an outer jacket surrounding at least a portion of the discharge vessel, the outer jacket having a first and a second end region disposed generally opposite each other;

wherein the second end regions of the discharge vessel and the outer jacket are coupled to the base.

7. The HID lamp of claim 6, wherein at least a portion of the cathode extends from the first end region of the discharge vessel and exits the first end region of the outer jacket, and at least a portion of the anode extends from the second end region of the discharge vessel and exits the second end region of the outer jacket; and wherein the electrically conductive starting aid comprises:

an electrically conductive coating disposed on a portion of the discharge vessel;

an electrically conductive member coupled to the conductive coating; and an electrically conductive return wire coupled to the conductive member, the conductive wire comprising a first end coupled to the cathode, an intermediate portion extending at least a length of the discharge vessel, and a second end configured to be electrically coupled to the power supply.

8. The HID lamp of claim 7, wherein at least a portion of the conductive member extends through the first end region of the outer jacket, and wherein the conductive coating is disposed on an exterior surface of the discharge vessel and extends from the first end region of the discharge vessel.

9. The HID lamp of claim 7, wherein at least a portion of the conductive member extends through the second end region of the outer jacket, and wherein the conductive coating is disposed on an exterior surface of the discharge vessel and extends from the second end region of the discharge vessel.

10. The HID lamp of claim 6, wherein the electrically conductive starting aid comprises:

an electrically conductive winding disposed around a portion the second end region of the discharge vessel; and an electrically conductive return wire coupled to the conductive winding, the return wire comprising a first end coupled to the cathode, an intermediate portion extending at least a length of the discharge vessel, and a second end configured to be electrically connected with the power supply;

wherein the return wire is disposed within a chamber defined by the outer jacket.

11. A high-intensity discharge (HID) lamp system comprising:

a HID lamp comprising:

a discharge vessel comprising a first and a second end region and defining an arc chamber containing an arc generating medium;

a cathode and an anode in the first and the second end regions of the discharge vessel, respectively, the cathode and the anode each comprising a terminal end disposed within the arc chamber and separated by an arc gap; and an electrically conductive starting aid configured to initiate a dielectric barrier discharge (DBD) with the anode at or after a voltage across the first and second electrodes reaches an open circuit value; and a ballast configured to control power provided to the HID lamp.

12. The HID lamp system of claim 11, wherein the electrically conductive starting aid is configured to delay the DBD 20-50 nanoseconds after the voltage across the cathode and the anode reaches the open circuit value.

13. The HID lamp system of claim 11, wherein the HID lamp further comprises:

a base configured to be received in a socket, said base comprising a first and a second connector configured to electrically connect the cathode, the anode, and the electrically conductive starting aid to the ballast; and an outer jacket surrounding at least a portion of the discharge vessel, the outer jacket having a first and a second end region disposed generally opposite each other;

wherein the second end regions of the discharge vessel and the outer jacket are coupled to the base.

14. The HID lamp system of claim 13, wherein at least a portion of the cathode extends from the first end region of the discharge vessel and exits the first end region of the outer jacket, and at least a portion of the anode extends from the second end region of the discharge vessel and exits the second end region of the outer jacket; and wherein the electrically conductive starting aid comprises:

an electrically conductive coating disposed on a portion of the discharge vessel;

an electrically conductive member coupled to the conductive coating; and an electrically conductive return wire coupled to the conductive member, the conductive wire comprising a first end coupled to the cathode, an intermediate portion extending at least a length of the discharge vessel, and a second end configured to be electrically coupled to the power supply.

15. The HID lamp system of claim 14, wherein at least a portion of the conductive member extends through the first end region of the outer jacket, and wherein the conductive coating is disposed on an exterior surface of the discharge vessel and extends from the first end region of the discharge vessel.

16. The HID lamp system of claim 14, wherein at least a portion of the conductive member extends through the second end region of the outer jacket, and wherein the conductive coating is disposed on an exterior surface of the discharge vessel and extends from the second end region of the discharge vessel.

17. The HID lamp system of claim 13, wherein the electrically conductive starting aid comprises:

an electrically conductive winding disposed around a portion the second end region of the discharge vessel; and an electrically conductive return wire coupled to the conductive winding, the return wire comprising a first end coupled to the cathode, an intermediate portion extending at least a length of the discharge vessel, and a second end configured to be electrically connected with the ballast;

wherein the return wire is disposed within a chamber defined by the outer jacket.

18. A method of igniting a high-intensity discharge (HID) lamp comprising:

providing a discharge vessel comprising a first and a second end region and defining an arc chamber containing an arc generating medium;

providing a first and a second electrode sealed in the first and the second end regions of the discharge vessel, respectively, the first and the second electrodes each comprising a terminal end disposed within the arc chamber and separated by an arc gap; and initiating a dielectric barrier discharge (DBD) with the second electrode at or after a voltage across the first and second electrodes reaches an open circuit value.

19. The method of claim 18, wherein initiating the DBD comprises delaying the DBD 20-50 nanoseconds after the voltage across the cathode and the anode reaches the open circuit value.

20. The method of claim 18, wherein the first and the second electrodes comprise a cathode and an anode, respectively, and wherein initiating the DBD comprises initiating the DBD with the anode.

* * * * *